US006792970B2

(12) United States Patent
Lin

(10) Patent No.: US 6,792,970 B2
(45) Date of Patent: Sep. 21, 2004

(54) FLAT WATER HOSE COILER

(75) Inventor: Pei-Ying Lin, Taichung Hsien (TW)

(73) Assignee: Global Industries Holdings Ltd., New Providence (BS)

( * ) Notice: Subject to any disclaimer, the term of this patent is extended or adjusted under 35 U.S.C. 154(b) by 0 days.

(21) Appl. No.: 10/352,648

(22) Filed: Jan. 27, 2003

(65) Prior Publication Data

US 2004/0094204 A1 May 20, 2004

(30) Foreign Application Priority Data

Nov. 19, 2002 (TW) ..... 91218740 U

(51) Int. Cl.[7] ..... B67H 75/34
(52) U.S. Cl. ..... 137/355.17; 137/355.26
(58) Field of Search ..... 137/355.17, 355.26

(56) References Cited

U.S. PATENT DOCUMENTS 2,629,630 A * 2/1953 Roark ..... 137/355.17
2,737,192 A * 3/1956 Bieler ..... 134/167 R
3,552,425 A * 1/1971 Olson ..... 137/355.17
4,092,997 A * 6/1978 Hansen ..... 137/351
4,543,982 A * 10/1985 Wolfe ..... 137/355.21
6,588,444 B2 * 7/2003 Paplow et al. ..... 137/15.01

* cited by examiner

*Primary Examiner*—A. Michael Chambers
(74) *Attorney, Agent, or Firm*—Leon I. Edelson; William C. Clarke; Levenfeld Pearlstein

(57) ABSTRACT

The present invention discloses a flat water hose coiler, comprising a hollow main shaft pivotally passing through a central hole of a middle partition, a water hose connecting section and a water outlet arc protruded outward from the hose body, and the water hose connecting section is for connecting a flat water hose, and the water outlet and is connected to a connecting shaft outside the hose, and a water hose connecting section is also disposed on the outside of the shaft for connecting another flat water hose; the shaft and the connecting shaft at their outer end each has a side ring cover; rotating the side ring cover can coil or release the flat water hose. The coiler accommodates two water hoses separately into the water hose accommodating space on both sides of the coiler. The coiling and releasing actions can be performed independently without interfering each other; the two independent water hoses regardless of being coiled or released, the water in the water hoses keeps on running.

20 Claims, 6 Drawing Sheets

FLAT WATER HOSE COILER

BACKGROUND OF THE INVENTION

1. Field of the Invention

The present invention relates to a water hose coiler, more particularly to a flat water hose coiler that can be operated in both directions for releasing or coiling the water hose.

2. Description of the Related Art

The collection of water hose relies on the application of coilers, which enables the user to coil water hoses quicker, more convenient, and neater. Further, the coiled water hose can have a better protection to prevent the water hose from being twisted, bent, or folded improperly and keeps the original shape of the hose to maintain the life of the water hose.

More considerations have been taken into account for the circular elastic hose or the thin and flat water hose made of waterproof cloth as those in the traditional hose coilers, but none for a special shaped elastic flat water hose has been disclosed.

SUMMARY OF THE INVENTION

The primary objective of the present invention is to provide a flat water hose coiler for coiling a flat water hose more quickly and convenient, protecting the hose better and extending the life of the water hose; the coiler will accommodate the two water hoses on both sides of the water accommodating space, such that the coiling and releasing of the water hoses on both sides can be performed independently without interfering with each other; the two independent water hoses can be interconnected by means of the structures of the main shaft and the connecting shaft, such that the water passages in the water hose regardless in the coiling or releasing state can be kept smooth.

To accomplish the foregoing objective, the present invention comprises a hollow main shaft pivotally passing through a central hole of a middle partition; a water hose connecting section and a water outlet protruded outward from the hose body; the water hose connecting section is for connecting a flat water hose, and the water outlet and is connected to a connecting shaft outside the hose; a water hose connecting section is also disposed on the outside of the main shaft for connecting another flat water hose; the main shaft and the connecting shaft at their outer end each has a side ring cover; rotating the side ring cover can coil or release the flat water hose.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 6:
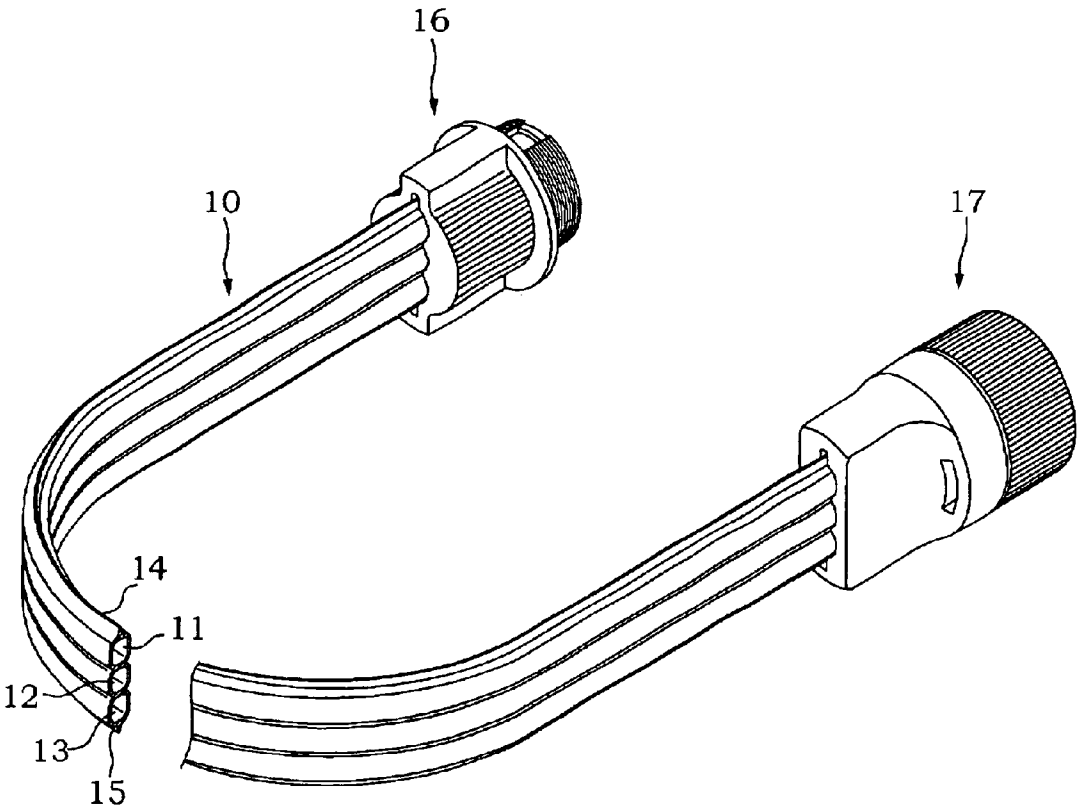
FIG. 6 is a perspective diagram of the flat water hose and its connector of the present invention.

Please refer to FIG. 6 for the flat water hose connector structure of the present invention, which includes a coiler specially designed for a special flat shaped water hose. The water hose 10 is made of PVC materials with elastic property. A plurality of water passages 11, 12, 13 arc disposed in parallel with each other inside the water hose 10, so that the cross-section of the water hose 10 is substantially in a flat shape. The middle of the outer sidewall of the water passages 11, 13 on both sides of the water hose 10 has a reinforced wing 14, 15 horizontally extended outward. The structural strength and supportability of the flat water hose 10 are stronger than those of the prior-art circular water hose, and will not be twisted, bent, or deformed easily.

Figure 1:
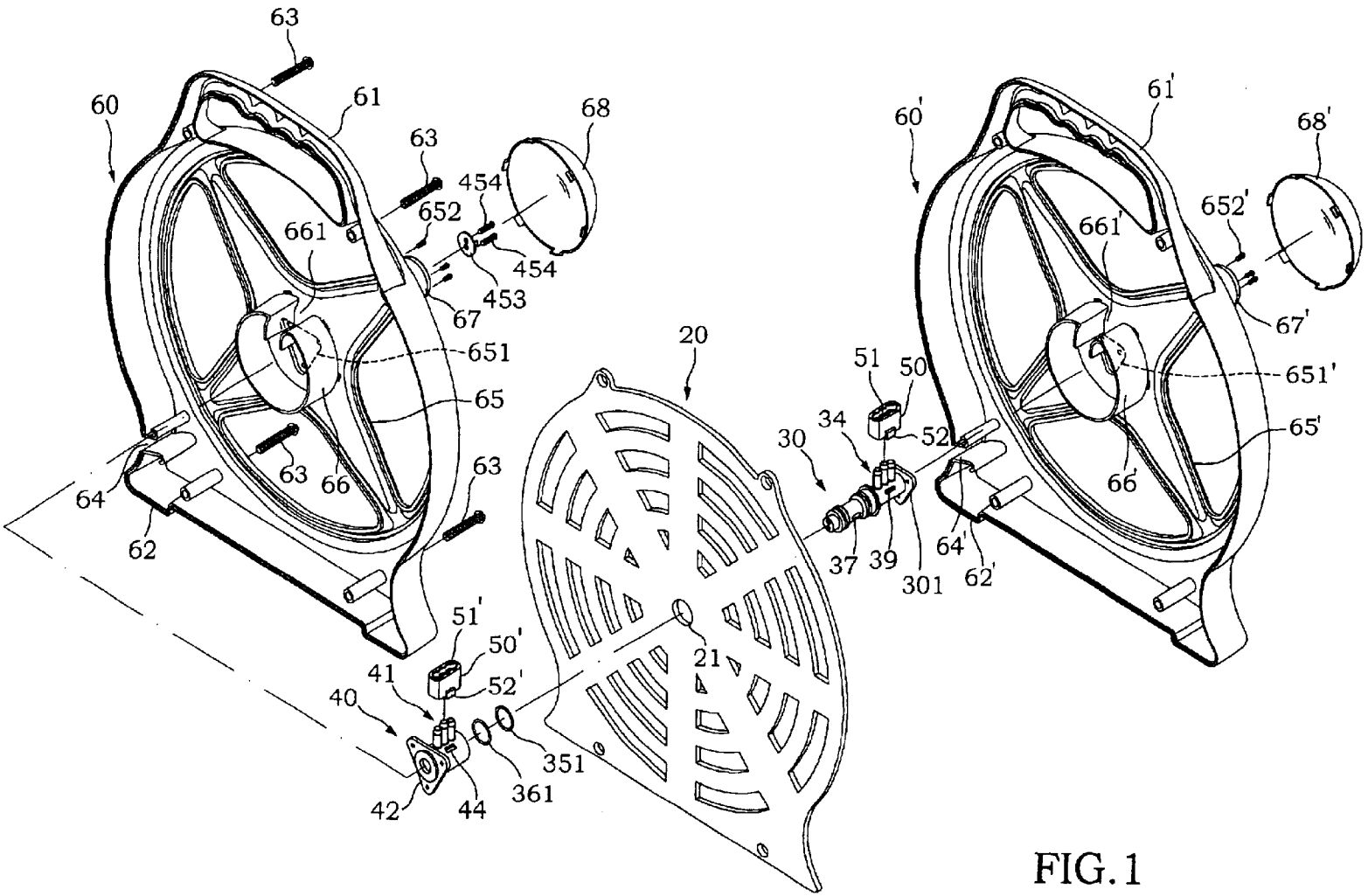
FIG. 1 is a diagram of the disassembled parts of the coiler of the present invention.
Figure 3:
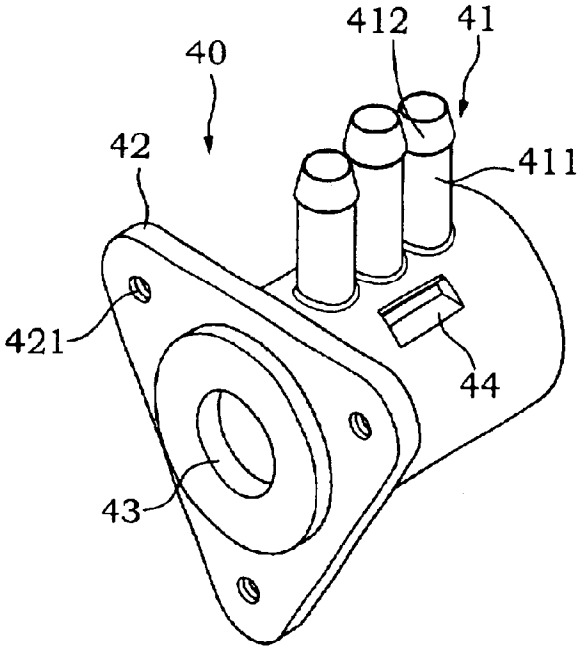
FIG. 3 is a perspective diagram of the connecting shaft of the present invention.
Figure 2:
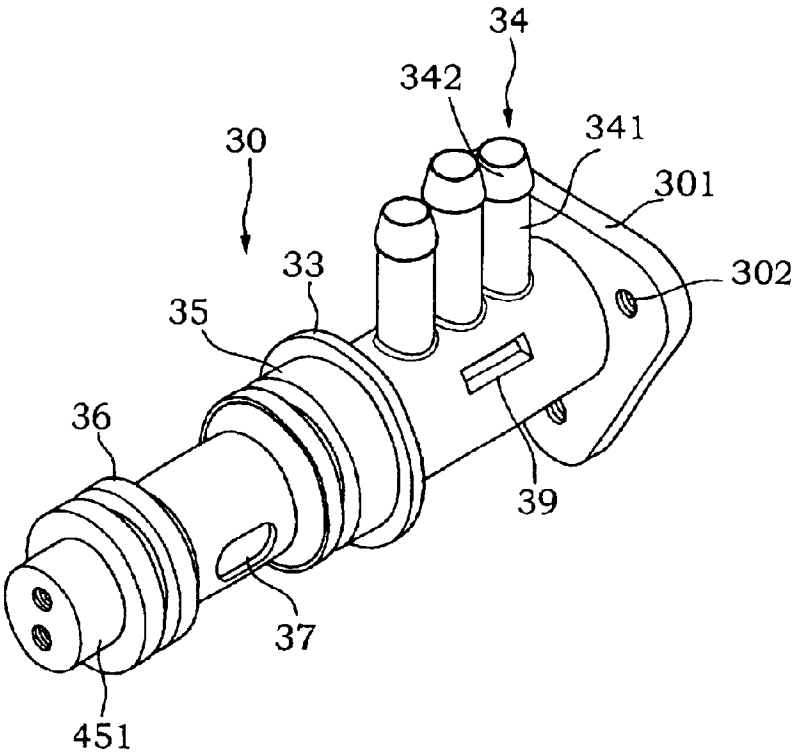
FIG. 2 is a perspective diagram of the main shaft of the present invention.
Figure 4:
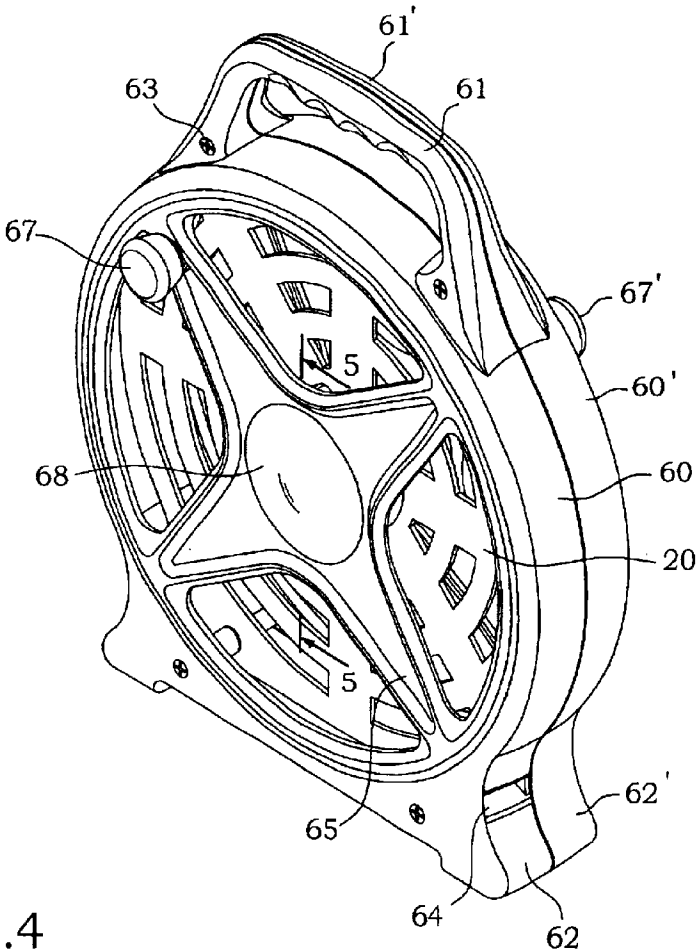
FIG. 4 is a perspective diagram of the assembled coiler of the present invention.
Figure 5:
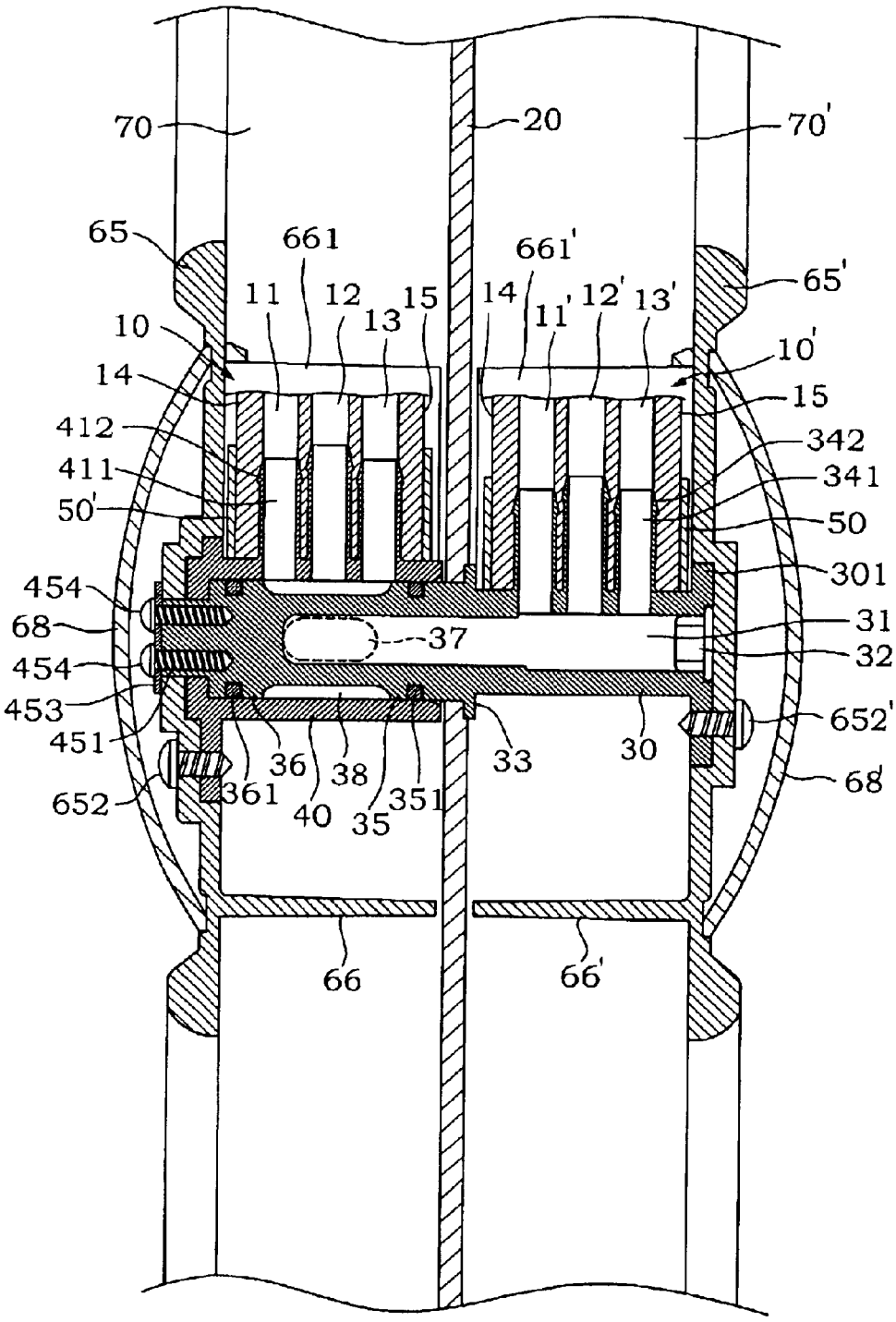
FIG. 5 is a cross-sectional diagram of the cross-section 5—5 and the arrow direction as indicated in FIG. 4.

The aforementioned coiler for flat water hose 10 comprises:

a middle partition 20 as shown in FIGS. 1 and 5, is a hollow circular plastic plate for this embodiment, and has a central hole 21 in the center of the middle partition 20;

a main shaft 30 as shown in FIGS. 1, 2, and 5, substantially in the shape of circular axle, having one end extended externally to form a polygonal fixing plate 301, and the fixing plate 301 at its periphery has a plurality of fixing holes 302; the main shaft 30 at the central axis has a water passage 31, and the end of the water passage 31 is close-ended, and the front end is open due to the formation of the hole, therefore a sealing up stopper 32 is tightly plugged into the front end; the main shaft 30 passes through the central hole 21 of the middle partition 20, and a blocking ring 33 is protruded outward from substantially the middle of the outer wall; a water hose connecting section 34 is protruded outward and disposed on the hose body between the blocking ring 33 and the fixing plate 301 for coupling the flat water hose 10. The water hose connecting section 34 sets the number of hollow splitters 341 depending on the number and arrangement of the water passages 11, 12, 13, and the interior of the hollow splitters 341 is connected with the water passage 31; the external open end has a protruded conical end 342; since the lengths of the hollow splitters 341 are different, the conical ends on the left and right sides are separated; the protruded conical end 342 is to increase the tightness of holding the water hose 10, and the separated conical end 342 is to prevent the protruded structure from colliding with each other and affecting the disposition of the water hose; furthermore, two outwardly protruded connecting rings 35, 36 are disposed on the hose body between the blocking ring 33 to the tail of the main shaft 30, and the wall of the shaft 30 between the two connecting rings 35, 36 has an water outlet 37; the two connecting rings 35, 36 each has a sealing up ring 351, 361;

a connecting shaft 40 as shown in FIGS. 1, 3, and 5 is disposed on the two connecting rings 35, 36 of the main shaft 30 on the side other than that of the middle partition 20; a gap exists between the inner wall of the connecting shaft 40 and the main shaft 30, with a hose body having water outlet 37, and such gap forms a water accommodating space 38; a water hose connecting section 41 is protruded from the hose body of the connecting shaft 40 for coupling the end of the flat water hose 10'; the water hose connecting section 41 sets the number of the hollow splitters 411 according to the number and arrangement of the water passages 11', 12', 13' of the water hose 10', and the interior of the hollow splitter 411 is interconnected with water accommodating space 38; the external open end has an outwardly protruded conical end 412; since the lengths of the hollow splitters 411 are different, therefore the conical ends 412 adjacent to the left and right sides are separated to prevent the protruded structure from colliding with each other and affecting the disposition of the water hose 10'; the connecting shaft 40 at its end has a polygonal fixing plate 42 extended outward, and the fixing plate 42 at its periphery has a plurality of fixing holes 421, and a blocking section 43 disposed outside the end of the main shaft 30 and tightly latched with the water blocking ring 361;

two water hose fixers 50, 50' as shown in FIGS. 1, 5 each has a water hose hole 51, 51' with a shape corresponsive to the cross-section of the water hose 10, 10' for coupling the end of the water hose 10, 10'; when the water hose 10, 10' is sheathed onto the water hose connecting section 34 of the main shaft 30 and the connecting shaft 40, the two water hose fixers 50, 50' are pressed outside the hollow splitters 341, 411 to latch the ends of the water hose 10, 10' between the hollow splitter 341, 411 and the water hose fixer 50, 50', so that the water hose 10, 10' is secured without the risk of falling apart; the bottom on each of both ends of the two water hose fixers 50, 50' has latch member 52, 52' to latch into the preset latch groove 39, 44' of the hose body of the main shaft 30 and the connecting shaft 40;

two side ring covers 65, 65' as shown in FIGS. 1 and 5 are star-shaped frame rings made of radiation decorative board, and have a polygonal groove 651, 651' in the middle for respectively latching the fixing plates 301, 42 at the ends of the main shaft and the connecting shaft and being fixed by screws 652, 652' such that the two side ring covers 65, 65' respectively link and couple to the main shaft 30 and the connecting shaft 40, and define a water accommodating space 70, 70' with the middle partition 20; a bobbin 66, 66' disposed outside the main shaft 30 and the connecting shaft 40, and the bobbin has an opening 661, 661' for passing and coupling the end of the water hose 10, 10' onto the water hose connecting section 34, 41, and a handle member 67, 67' disposed along the periphery outside the two side ring covers 65, 65' for the user to hold and turn the side ring cover 65, 65';

a main shaft balancing structure as shown in FIGS. 1, 2, and 5, has a supporting section 451 extended along an axial direction from one end of the fixing plate 301 away from the main shaft 30, and such supporting section 451 passes through the end of the connecting shaft 40 and the center of the side ring cover 65', and the other end is pivotally coupled into another side ring cover 65' such that both ends of the main shaft 30 can be supported and balanced;

two casings 60, 60' as shown in FIGS. 1 and 4 disposed on the outer side of the two side ring covers 65, 65', and its main structure is in the shape of a circular frame, and its top has a halved handle 61, 61', and its bottom has a halved footer, and the two casings are aligned and coupled to hold the middle partition 20 in between and secured by screws; the two halved handles 61, 61' constitute a handle for the user to hold, and the two halved footers 62, 62' form a stable footer; each casing 60, 60' has a water hose outlet 64, 64' for letting the open end of the two water hoses 10, 10' to pass through;

two central decorative boards 68, 68' embedded into the central exterior section of the side ring cover 65, 65' to cover and secure the screws of the main shaft 30 and the connecting shaft 40 for decoration.

Figure 7:
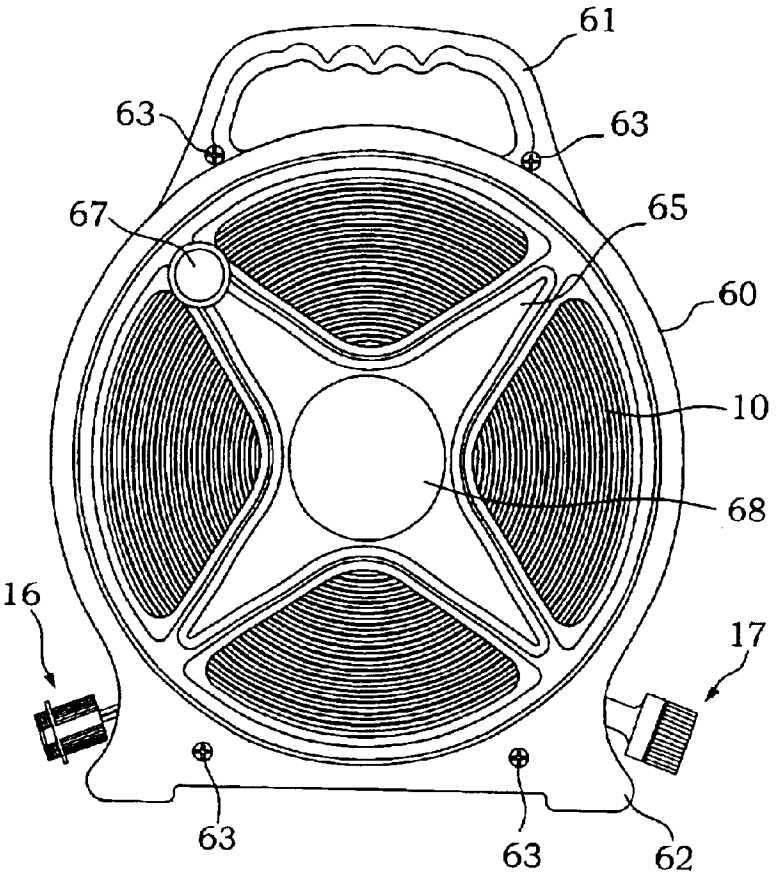
FIG. 7 is a reference diagram of an application of the present invention.

By means of the aforementioned structure, when the user holds the handle member 67, 67' on either side, the side ring covers 65, 65' on the same side can be rotated, because the main shaft 30 and the connecting shaft 40 are fixed by the fixing plates 301, 42 and the side ring covers 65, 65'. Therefore the side ring covers 65, 65' respectively drive the main shaft 30 and the connecting shaft 40, and the bobbins 66, 66' also rotate accordingly to coil the water hoses 10, 10' and further store them inside the water hose accommodating space 70, 70'. The water hoses 10, 10' are neatly coiled as shown in FIG. 7, and will not be twisted, pressed, folded, or have the problem of deformation. Therefore, the water passages 11, 11', 12, 12', 13, 13' of the entire water hose are kept running smoothly. On the other hand, if the side ring covers 65, 65' are turned in the opposite direction to release the water hoses 10, 10' from the bobbins 66, 66', the user can pull the water hoses 10, 10' out to an appropriate length. Since the main shaft 30 and the connecting shaft 40 are movably coupled, therefore they can be driven by the side ring covers 65, 65' respectively and will not interfere with each other. Thus, the water hoses 10, 10' on both sides can be coiled or released independently without interfering with each other.

When the side ring cover 65 is rotated to fix the main shaft 30 into position, one end of the supporting section 451 drives two screws 454 and a washer 453 on the other side of the side ring cover 65' to turn without moving forward. Therefore, the other side ring cover 65' is not driven, but remains still.

The end of the water hose extended from the coiler can be connected to a connector 16, 17 as shown in FIGS. 6 and 7, wherein one connector can be connected to a faucet, and the other connector to a tool such as a sprinkler. The water filled from the faucet into the water passages 11, 12, 13 of the water hose 10 regardless in the extension section or tile coiling section is without obstruction, therefore the water can successfully enter the water passage 31 of the main shaft 30 from the water hose connecting section 34, and fill up the water accommodating space 38 through the water outlet 37, and further into the water passages 11', 12', 13' of another water hose 10' in the water hose connecting section of the connecting shaft 40, and then is sprayed out from the sprinkler. The water in the water accommodating space 38 can be sealed by the sealing up ring 351, 361 to prevent leaking.

After disclosing the structure and application of the present invention, the inventor further describes the improvements made by the present invention below:

a. In the present invention, two water hoses are accommodated in the coiler on both sides of the water accommodating spaces 70, 70', and the coiling and releasing of water hose 10, 10' on both sides can be performed independently without interfering with each other.

b. Even the two water hoses are independent hoses, but by means of the structure arrangement of the main shaft 30 and the connecting shaft 40, their water passages 11, 11', 12, 12', 13, 13' are interconnected. The design for the coupling and movement of the main shaft 30 and the connecting shaft 40 do not affect the coiling and releasing of the two water hoses independently.

c. The water hoses 10, 10' are coiled and stored neatly into the coiler, and will not be twisted, pressed, folded, or have the problem of deformation. Therefore, the water passages 11, 11', 12, 12', 13, 13' in the entire hose regardless in the extension section or coiling section can be kept running smoothly.

d. The present invention provides a simple and easy operation by simply rotating the handle member 67, 67' to drive and rotate the side ring covers 65, 65' in order to coil or release the water hose 10, 10'. The user can also pull the water hose 10, 10' to release them for use.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flat water hose coiler, comprising:

a middle partition, at its center having a central hole;

a main shaft hose, substantially in cylindrical shape, passing through the central hole of the middle partition, and in the direction of its central axis having water passage being closed on two ends, the end proximate the hose body having a water hose connecting section connected to the water passage protruded outward for coupling to a flat hose; another end of the hose body proximate the main shaft having two coupling rings protruded outward, and a water outlet disposed on the hose body of the shaft between the two coupling rings;

a connecting shaft, sheathing on the two coupling rings of the main shaft and disposed on another side of the middle partition; the inner wall of the connecting shaft and the main shaft having a water accommodating space between the water outlet of the hose body; a water hose connecting section connected to the water accommodating space protruded outward from the diameter of the connecting shaft for coupling an end of another flat water hose;

two water hose,fixers, in their interior having a water hose hole corresponsive to the shape of the cross-section of the water hose for passing the end of the water hose into the water hose hole, and when the water hose being coupled to the water hose connecting section of the main shaft and the connecting shaft, the two water hose fixers pressing tightly at the water hose connecting section to fix the end of the water hose between the water hose connecting section and the water fixer;

two side ring covers, with its center individually coupled to the outer ends of the main shaft and the connecting shaft; the two side rings having a bobbin corresponsive to the external axial direction of the main shaft and the connecting shaft, and the bobbin having an opening for passing and coupling an end of the water hoses to the water hose connecting section, and the hose body being coiled outside the bobbin.

2. The flat water hose coiler of claim 1, wherein said flat water hose in its interior comprise a plurality of parallel water passages such that the cross-section of the water hose is substantially in a flat shape.

3. The flat water hose coiler of claim 2, wherein said water passage on each of both sides of the water hose a horizontally extended outward reinforced wing at the external sidewall of the water passage.

4. The flat water hose coiler of claim 2, wherein said water hose connecting section of the main shaft has a number of hollow splitters depending on the number and arrangement of the water passages, and the interior of the hollow splitter is connected to the water passage inside the main shaft.

5. The flat water hose coiler of claim 4, wherein said hollow splitter at its external open end has a protruded conical end, and the different lengths of the hollow splitters separate the conical ends proximate the left and right sides.

6. The flat water hose coiler of claim 2, wherein said water hose connecting section of the connecting shaft has a number of hollow splitters depending on the number and arrangement of the water passages, and the interior of the hollow splitter is connected to the water accommodating space.

7. The flat water hose coiler of claim 6, wherein said hollow splitter at its external open end has a protruded conical end, and the different lengths of the hollow splitters separate the conical ends proximate the left and right sides.

8. The flat water hose coiler of claim 1, wherein said main shaft and said side ring cover at their fixed ends have a polygonal fixing plate extended outward, and the side ring cover at its center has a polygonal groove for latching the fixing plate of the main shaft and being secured by a screw component.

9. The flat water hose coiler of claim 1, wherein said connecting shaft and side ring cover at their fixed ends have a polygonal groove for latching the fixing plate extended outward, and the side ring cover at its center has a polygonal groove for latching the fixing plate of the main shaft and being secured by a screw component.

10. The flat water hose coiler of claim 1, wherein said connecting shaft at the outside of its two coupling rings has a sealing up ring to seal the inner wall of the connecting shaft.

11. The flat water hose coiler of claim 1, wherein said connecting shaft two water hose fixer at its bottom has a hook to anchor the body of the main shaft and the connecting shaft into the preset latching groove.

12. The flat water hose coiler of claim 1 further comprising two housings disposed outside the two side ring covers.

13. The flat water hose coiler of claim 12, wherein said two housing are substantially in the shape of a circular frame, each having a halved handle at the top of the top surface of the housing, and a halved footer; two halved handles constitute a handle for holding, and two halved footers constitute a stable footer.

14. The flat water hose coiler of claim 13, wherein said housing has a water hose outlet for receiving the open end of the two water hose.

15. The flat water hose coiler of claim 14, wherein said open end of the flat water hose extended from the coiler has a connector.

16. The flat water hose coiler of claim 15, wherein said connector is a faucet.

17. The flat water hose coiler of claim 15, wherein said connector is a sprinkler.

18. The flat water hose coiler of claim 1, wherein said two side ring covers at their outer sides have a gripping member.

19. The flat water hose coiler of claim 1 further comprising a main shaft balancing structure such that the ends adjacent to the main shaft and the connecting shaft pivotally coupled to the center of the side ring cover fixed on the connecting shaft.

20. The flat water hose coiler of claim 19, wherein said main shaft balancing structure at the ends adjacent to the main shaft and the connecting shaft has a supporting section extended outward, and said supporting section passes through the end of the connecting shaft and the center of the fixed side ring cover; a washer is disposed on the outside of the center of the side ring cover, and two screws pass through the washer and are secured onto the supporting section.

* * * * *